US009922513B1

(12) United States Patent
Hall et al.

(10) Patent No.: US 9,922,513 B1
(45) Date of Patent: Mar. 20, 2018

(54) METHOD AND SYSTEM FOR MONITORING THE DELIVERY OF A PACKAGE TO THE INTERIOR OF A BUILDING

(71) Applicants: David R. Hall, Provo, UT (US); Mark Hall, Springville, UT (US)

(72) Inventors: David R. Hall, Provo, UT (US); Mark Hall, Springville, UT (US)

( * ) Notice: Subject to any disclaimer, the term of this patent is extended or adjusted under 35 U.S.C. 154(b) by 0 days.

(21) Appl. No.: 15/421,690

(22) Filed: Feb. 1, 2017

(51) Int. Cl.
*G08B 13/196* (2006.01)
*G07C 9/00* (2006.01)

(52) U.S. Cl.
CPC ..... *G08B 13/196* (2013.01); *G07C 9/00142* (2013.01)

(58) Field of Classification Search
CPC ..... G08B 13/196; G07C 9/00412; G07C 2009/00095; G07C 9/00039; G07C 2009/00079; G07C 9/00309; G07C 2009/00563; G07C 9/00158; G06K 9/00288; G06K 9/00302
USPC ... 340/540, 541, 542, 568.1, 5.2, 5.52, 5.53, 340/5.54, 5.63, 5.8, 5.81, 5.82, 5.83, 5.84; 235/377, 382
See application file for complete search history.

(56) References Cited

U.S. PATENT DOCUMENTS 6,300,873 B1 * 10/2001 Kucharczyk ..... A47G 29/141 235/382.5
2001/0045449 A1 * 11/2001 Shannon ..... A47G 29/141 232/19
2001/0050615 A1 * 12/2001 Kucharczyk ..... A47G 29/141 340/568.1
2016/0253898 A1 * 9/2016 Cobb ..... H04L 12/2825 340/541
2016/0275735 A1 * 9/2016 Carstens ..... A47G 29/141
2017/0076520 A1 * 3/2017 Ho ..... G07C 9/00079
2017/0251856 A1 * 9/2017 Schaible ..... A47G 29/20

* cited by examiner

*Primary Examiner* — Hung T Nguyen

(57) ABSTRACT

An apparatus for receiving parcel through a door, the apparatus includes a processor communicatively connected to a network interface connection, a passcode entry station, an interior camera, a non-transitory storage medium. The non-transitory storage medium includes a receive module, an obtain module, an unlock module, an alarm module, and a lock module. The receive module receives, over the network interface connection, a number of access configuration parameters. The number of access configuration parameters comprising an access code and an access time. The obtain module obtains, from an access code input device, an input access code. The input access code indicates that a user has requested limited access to an area for parcel delivery according to the access configuration parameters. The unlock module unlocks a door to allow parcel delivery. The monitor module monitors that the parcel delivery person remains in the field of vision of the interior camera. The alarm module issues, using the network interface connection, an alarm when the parcel delivery person leaves the field of vision of the interior camera. The lock module locks the door after the parcel is delivered.

20 Claims, 6 Drawing Sheets

METHOD AND SYSTEM FOR MONITORING THE DELIVERY OF A PACKAGE TO THE INTERIOR OF A BUILDING

TECHNICAL FIELD

The disclosure relates generally to the field of parcel delivery and retrieval. Specifically, the disclosure relates to the delivery of a parcel to a destination.

BACKGROUND

The Internet and other technological changes have brought about sweeping changes in communications and commerce. While overnight parcel delivery services have become commonplace in recent years (for example, Federal Express, United Parcel Service, and Airborne), these services have great difficulty delivering to individual homes. The occupant of the home is often not there (being at work, for example) and thus a carrier may have to visit the home two or more times to effect delivery. Often, a parcel delivery person will leave a parcel unattended. An unattended parcel may be stolen, causing inconvenience for the occupant and cost for the retailer. A sophisticated thief may place a fraudulent order using a stolen credit card. The thief has the parcel delivered to a house where the resident is often not present and then steals the parcel when it is left unattended.

Some retailers have used is placing a number of containers at a predetermined location, such as a grocery store or post office. The parcel recipient receives a message that the parcel has been delivered to the predetermined location. The parcel recipient then retrieves the parcel from the predetermined location. This solution allows for the parcel to be kept in a secure location at all times. However, this solution also has the parcel recipient travel to the predetermined location to retrieve a parcel, similar to a post office box. This may delay the receipt of the parcel. The travel of the parcel recipient may cause environment problems, such as pollution from a vehicle or traffic congestion. A successful retailer may be challenged by having all containers at the predetermined location being in use, complicating the delivery of parcels.

Security of parcels and parcel theft has become a challenge for both retailers and consumers. Parcel theft harms many members of society and increases the cost of merchandise.

BRIEF SUMMARY

An apparatus for receiving parcels through a door includes a processor and, communicatively connected to the processor, a network interface connection, a passcode entry station, an interior camera, and a non-transitory storage medium. The non-transitory storage medium includes a receive module, an obtain module, an unlock module, a monitory module, an alarm module, and a lock module. The receive module causes the apparatus to receive, over the network interface connection, a number of access configuration parameters, the number of access configuration parameters comprising an access code and an access time. The obtain module causes the apparatus to obtain, from an access code input device, an input access code, the input access code indicating that a user has requested limited access to an area for parcel delivery according to the access configuration parameters. The unlock module causes the apparatus to unlock a door to allow parcel delivery. The monitor module causes the apparatus to monitor that the parcel delivery person remains in the field of vision of the interior camera. The alarm module causes the apparatus to issue, using the network interface connection, an alarm when the parcel delivery person leaves the field of vision of the interior camera. The lock module causes the apparatus to lock the door after the parcel is delivered.

A method for receiving a parcel through a doorway using a parcel delivery apparatus is described. The method includes receiving, over a network interface connection, a number of access configuration parameters, the number of access configuration parameters comprising an access code and an access time. The method includes obtaining, from an access code input device, an input access code, the input access code indicating that a user has requested limited access to an area for parcel delivery according to the access configuration parameters. The method includes unlocking a door to allow parcel delivery. The method includes monitoring parcel placement within a expected field of vision of the interior camera; the method includes issuing, using the network interface connection, an alarm when the parcel delivery person leaves the expected field of vision of the interior camera. The method includes locking the door after the parcel is delivered;

BRIEF DESCRIPTION OF THE DRAWINGS

A more particular description of the invention briefly described above is made below by reference to specific example. Several examples are depicted in drawings included with this application. An example is presented to illustrate, but not restrict, the invention.

DETAILED DESCRIPTION

Figure 1:
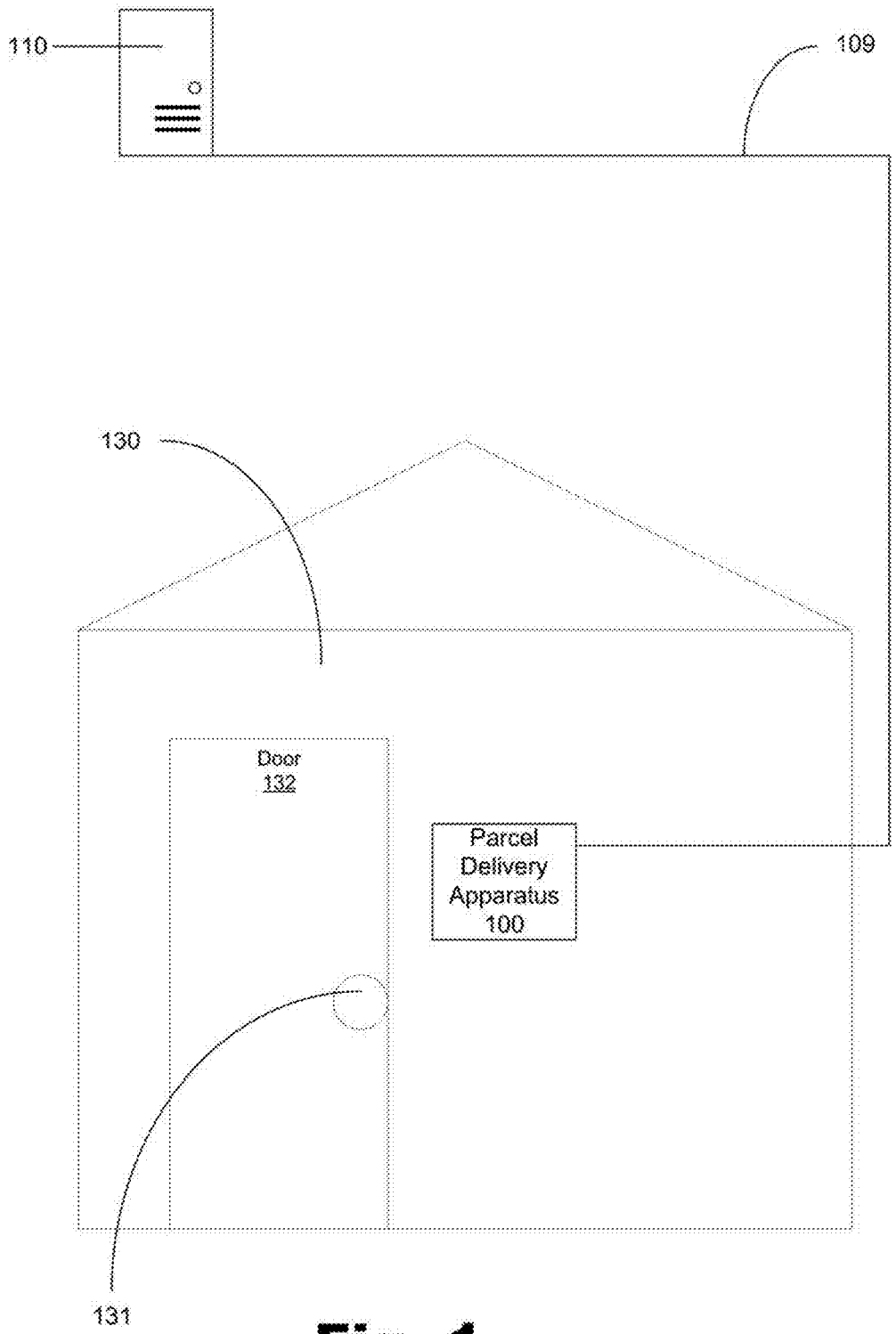
FIG. 1 illustrates a diagram of a use for a parcel delivery apparatus.

A detailed description of the claimed invention is provided below by example, with reference to examples in the appended figures. Those of skill in the art will recognize that the components and steps of the invention as described by example in the figures below could be arranged and designed in a wide variety of different configurations without departing from the substance of the claimed invention. Thus, the detailed description of the examples in the figures is merely representative examples of the invention, and is not intended to limit the scope of the invention as claimed.

In some instances, numerical values are used to describe features such as spreading factors, output power, bandwidths, link budgets, data rates, and distances. Though precise numbers are used, one of skill in the art recognizes that small variations in the precisely stated values do not substantially alter the function of the feature being described. In some cases, a variation of up to 50% of the stated value does not alter the function of the feature. Thus, unless otherwise stated, precisely stated values should be read as the stated number, plus or minus a standard variation common and acceptable in the art.

For purposes of this disclosure, the modules refer to a combination of hardware and program instructions to perform a designated function. Each of the modules may include a processor and memory. The program instructions are stored in the memory, and cause the processor to execute the designated function of the modules. Additionally, a smartphone app and a corresponding computer system for the smartphone app may be used to control the access control.

A purpose of the claimed methods and computer program product is to facilitate the delivery of parcels to a parcel recipient. In one example, the parcel recipient may be a retail consumer having a parcel delivered to the recipients dwelling. In a different example, a business may have a number of parcels delivered. A parcel may be a container that contains additional items or parcels.

The parcel delivery system may use wireless networking protocols. The wireless networking protocols may include any protocol used with Internet of Things ("IoT") including but not limited to Bluetooth, ZigBee, Ethernet, WirelessHART, DigiMesh, ISA100.11a, IEEE 802.15.4, NFC, ANT, Eddystone, EnOcean, Wi-Fi, and WiMAX. The wireless communication protocol allows the parcel delivery apparatus to communicate with a computing device associated with the person receiving the parcel or with a central server that communicates a combination of the parcel recipient, the parcel delivery service, and the parcel provider.

The method for operating a parcel delivery apparatus may be implemented by an apparatus that maintains a two-way connection between the parcel delivery apparatus and a control server. In one example a parcel delivery system communicates with a control server to receive information about a parcel to be delivered, uses that information to confirm the receipt of the correct parcel, and transmits information to the control server information about the parcel delivered and the parcel delivery apparatus.

With a control server connected to an apparatus that implements a method, a two-way connection may be maintained. The control server and the Wi-Fi router may communicate over a hardwired connection such as Ethernet, coaxial cable, or fiber optic cable. The device data server and the Wi-Fi router may communicate using a wireless protocol, such as 802.1(g), 802.1(n), or another wireless protocol.

For purposes of this disclosure as used in the present specification and in the appended claims the term "parcel" refers to a thing that is rapped, packaged, or prepared for shipment. A parcel may be used to ship goods in a retail transaction or may be used to privately distribute a gift or goods.

As used in the present specification and in the appended, the term door means a particular device, system, or apparatus used to prevent passage past the device, system, or apparatus.

As used in the present specification and in the appended, the term sensor refers to a device that detects or measures a physical property and records, indicates, or otherwise responds to the detection or measurement.

As used in the present specification and in the appended, the term communication refers to the imparting or exchange of information.

As used in the present specification and in the appended, the term radio frequency identification or RFID refers to a device that self identifies using radio frequencies. Identification may involve an active transmission of information. Identification may occur by a device that resonates based on an input frequency and the resonation causes an output frequency which can be used to identify the RFID device. An RFID device may be affixed to an apparatus or parcel to identify the apparatus or parcel.

As used in the present specification and in the appended, the term camera refers to a device capable of storing an image, or a series of images, in view of the sensor of a device. A camera may create a digital image or series of images. A camera creating a series of images may store or communicate the series of images using a video format.

As described above, a myriad of problems complicate delivery of parcels to a location where the parcel may be left unattended. When the parcel is left unattended, the parcel may be stolen. The stolen parcel may be blamed on the delivery person, or may cause additional cost for a party who shipped the parcel. Additionally, the parcel may be left in place and vandalized, causing damage that could harm a parcel recipient, a parcel delivery agent, or a party who ships the parcel.

A parcel retrieval system that leaves the parcel delivery location, meets a parcel deliverer, receives the parcel, and returns the parcel to a secure location may address these problems. A parcel retrieval system allows for the "last mile" to be done by a short range retrieval apparatus pulling the parcel to a secure location rather than a delivery system pushing a parcel to one of millions of potential parcel recipients. A parcel delivery service may provide shipping discounts or rebates to parties that make use of a parcel delivery apparatus. A retailer may provide also provide discounts to a party that uses a parcel delivery apparatus, as the retailer may experience lower rates of inventory loss.

Referring now to the figures, FIG. 1 illustrates a system for receiving a parcel using a parcel delivery apparatus, according to one example of the principles described herein. As illustrated, a parcel delivery apparatus (100) is affixed to a house (130). The house includes a door (132) with a lock (131). The parcel delivery apparatus (100) has a network connection (111) to a central server (110). The parcel delivery apparatus (100) allows for the delivery of a parcel through the door (132).

An overall example will be given according to FIG. 1. A parcel delivery apparatus (100) is stationed on a house (130). The parcel delivery apparatus (100) may use electricity from the house (130) or may use a battery for electricity. The parcel delivery apparatus (100) may monitor usage of the door (130) for other purposes. The parcel delivery apparatus (100) receives information from the central server (110) describing a parcel to be delivered. This information may include a passcode, biometric data, a description of the parcel, and a timeframe the parcel is to be delivered in.

A parcel delivery person receives a parcel to be delivered with information to deliver the parcel. The parcel delivery person arrives at a home (130) to deliver a parcel. The parcel delivery person approaches the door (132).

The parcel delivery person then enters passcode information to the parcel delivery apparatus (100). The parcel delivery apparatus (100) authenticate the passcode. The parcel delivery apparatus (100) unlocks the lock (131) on the door (132).

The parcel delivery apparatus (100) monitors that the parcel delivery person stays inside of a delivery zone. The parcel delivery person opens the door (132), places the parcel inside, and closes the door (132). The parcel is inside the house (130). The parcel delivery apparatus (100) locks the lock (131) on the door (132).

Figure 2:
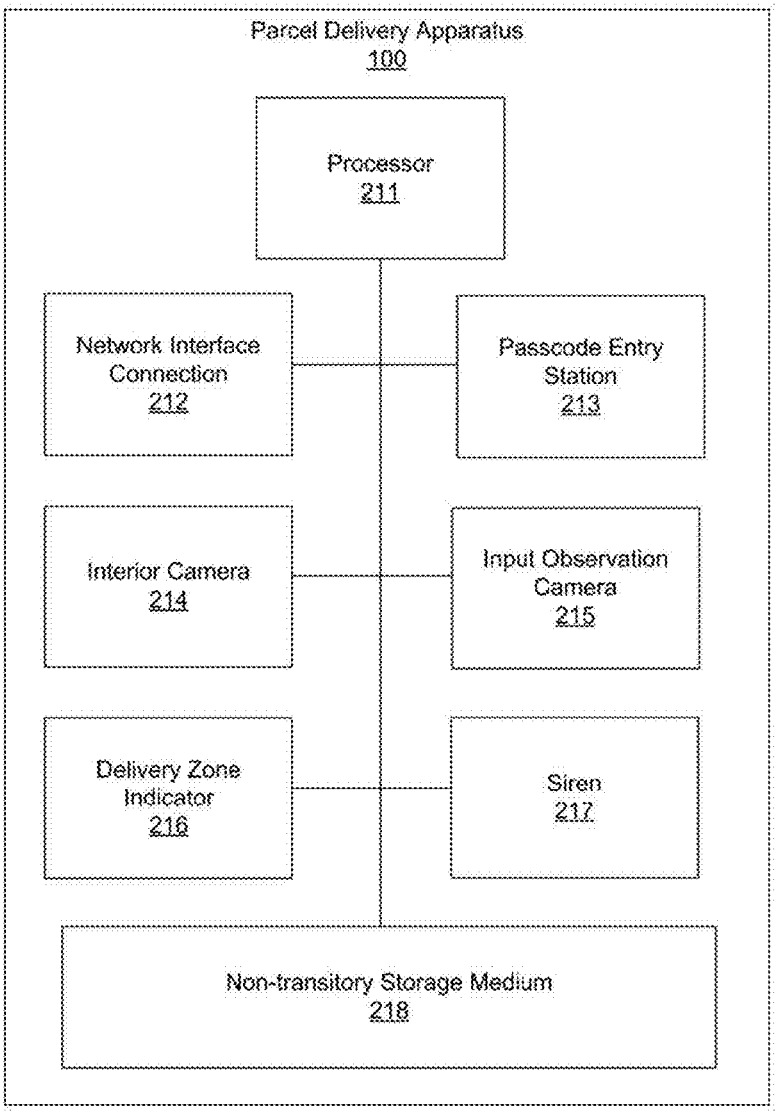
FIG. 2 illustrates a diagram of a parcel delivery apparatus.

FIG. 2 illustrates a parcel delivery apparatus (100) for receiving a number of parcels that are delivered, according to one example of the principles described herein. The parcel delivery apparatus (100) includes a processor (211) that is communicatively connected to a network interface connection (212), a passcode entry station (213), an interior camera (214), and input observation camera (215), a delivery zone indicator (216), a siren (217) and a non-transitory storage medium (218).

The processor (211), when executing computer program code, activates other portions of the parcel delivery apparatus (100) to perform an intended task. The processor may be a single unit, or the processor may be a number of processing units associated with portions of the parcel delivery apparatus (100).

The Network Interface Connection (212) is used when the parcel delivery apparatus (100) communicates with a central server (FIG. 1, 110) or other device that interacts with the parcel delivery apparatus (100). The central server (FIG. 1, 110) may serve as a portal interface to other devices to access the parcel delivery apparatus (100). The central server (FIG. 1, 110) may reside with a service, such as a security service, that monitors and facilitates parcel delivery. The parcel delivery apparatus (100) may communicate directly with another device, such as a laptop, tablet, or smartphone.

The passcode entry station (213) includes a number of input devices or sensors that allow a passcode to be entered. A passcode entry station (213) may include a 10-key device, similar to a calculator or automated teller machine, to facilitate the input of a passcode. A passcode entry system (213) may include any number of keys that allow a user to enter a key sequence to verify identity to the passcode entry station (213). The passcode entry station (213) may include a number of biometric input sensors. Biometric input sensors may include fingerprint recognition, retina recognition, voice recognition, or facial recognition. A biometric input sensor may make a biometric recording that can be recorded to identify the user of the passcode entry station, even when the user is not an intended user.

The interior camera (214) may monitor the interior of a home (FIG. 1, 130), office, or other place for parcel delivery. The interior camera (214) may be used by the processor (211) to monitor that a parcel delivery person does not leave a parcel delivery zone. The interior camera (214) may be used to identify a warning zone. When a parcel delivery person is detected in a warning zone. A warning, by way of a siren or warning message, may be issued when a parcel delivery person enters the warning zone.

The input observation camera (215) may monitor the use of a passcode entry station. The input observation camera (215) may be used to perform facial recognition on a parcel delivery person using the passcode entry station (213). The input observation camera (215) may be used to record usage of the passcode entry station (213).

The Delivery zone indicator (216) is causes a display of an acceptable delivery zone to be displayed for a parcel delivery person. In one example, the delivery zone indicator (216) is a number of lasers that illuminate a parcel delivery zone. In another example, the delivery zone indicator (216) is light that illuminates a parcel delivery zone. In still another example, the delivery zone indicator (216) includes a series of LED's partially surrounding a parcel delivery zone.

The siren (217) is a device that emits a warning or other stimuli to scare a parcel delivery person or potential thief. The siren (217) may be a horn, a series of lights, or a speaker or a combination thereof. The speaker may emit a series of loud sounds or voices. The siren (217) may be used when a parcel delivery person attempts to access an area outside of the parcel delivery zone.

The non-transitory storage medium (218) stores a series of modules. Each module may contain computer program instructions, hardware, or combination thereof. Each module may interact with other portions of the parcel delivery apparatus (100) to perform a particular task.

Figure 3:
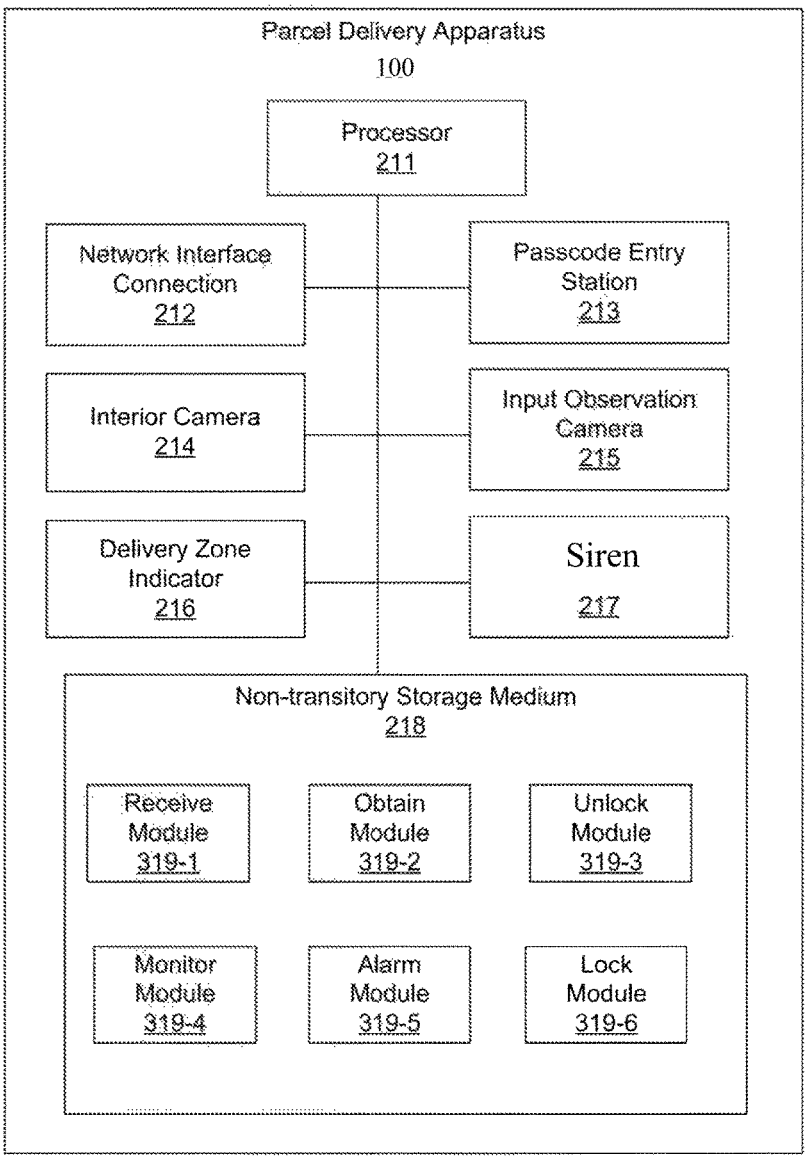
FIG. 3 illustrates a parcel delivery apparatus with a number of modules included in a non-transitory storage medium.

FIG. 3 illustrates a parcel delivery apparatus (100) for receiving a number of parcels that are delivered, according to one example of the principles described herein. As described above, the parcel delivery apparatus (100) includes a processor (211) that is communicatively connected to a network interface connection (212), a passcode entry station (213), an interior camera (214), and input observation camera (215), a delivery zone indicator (216), a siren (217) and a non-transitory storage medium (218).

The non-transitory storage medium (218) includes a number of modules (319). Each module (319) may contain computer program instructions, hardware, or combination thereof that causes the apparatus to perform a specific task. In this example, the non-transitory storage medium (218) includes a receive module (319-1), an obtain module (319-2), an unlock module (319-3), a monitor module (319-4), an alarm module (319-5), and a lock module (319-6).

The receive module (319-1) receives, over the network interface connection (212), a number of access configuration parameters. The number of access configuration parameters may include a number of an access code, an access time, facial recognition data, a fingerprint sample, a retina scan, a heat sensor reading, a genetic reading, or other biometric data. The access configuration information may include a time the access is to be granted and/or an amount of time for which access is to be granted. The access configuration includes information describing the parcel to be received. The information regarding the parcel to be received may verify the correct parcel is received. The receive module receives data used to identify a parcel delivery person.

The obtain module (319-2) obtains, from an access code input device, an input access code. The input access code indicating that a user has requested limited access to an area for parcel delivery according to the access configuration parameters. The input access code may contain a number of code, keys, tokens or readings. The input access code may include readings from an input device such as a 10 key or a keyboard. The input access code may include a photograph or video. The input access code may include a reading of a biometric sensor.

The unlock module (319-3) unlocks a door to allow parcel delivery. The door is unlocked when the input access data meets the criteria access configuration parameters. The parcel delivery person may then open the door to place the parcel.

The monitor module (319-4) monitors that the parcel delivery person remains in the field of vision of the interior camera. The interior camera may comprise a number of cameras that, when the images are combined, represent the field of vision of the interior cameras. The interior cameras may use night-vision technology, such as infrared illumination, to detect the parcel delivery person in low light conditions. The monitor module (319-4) may monitor that the parcel is placed in the delivery zone and that the parcel remains in the delivery zone when the parcel delivery person leaves the parcel delivery zone. The monitor module (319-4) may permit the parcel delivery person to leave through one edge of the field of vision, the one edge being recognized as the doorway leaving and an approved exit of the field of vision.

The alarm module (319-5) issues an alarm when the parcel delivery person leaves the field of vision of the interior camera. The alarm may be issued by sending a message using the network interface connection. The message may alert a central server of a violation of a delivery zone. The alarm module may cause a siren, light, or other attention attracting reaction in an attempt to scare or startle an individual who has exceeded the permissible scope of presence.

The lock module (319-6) locks the door after the parcel is delivered. The lock module (319-6) may verify that the door is closed. The lock module (319-6), by securing the door, secures the parcel.

A first overall example using FIG. 3 will now be given. In this example, a parcel carrier determines that a parcel is to be delivered to a home (FIG. 1, 130). The home (FIG. 1, 130) has a trusted relationship with the parcel carrier that allows the parcel carrier to deliver parcels for the resident. Access configuration parameters may be received from the resident after reviewing the access request. The resident determines that no resident will be home, and the parcel delivery apparatus (100). The resident approves that the parcel will be delivered, and the access configuration parameters are sent to the parcel delivery apparatus.

The receive module (319-1) receives, over the network interface connection (212), a number of access configuration parameters. The access configuration parameters are received from a resident after the resident has approved the access. The access configuration parameters include a delivery window, a process identification number (PIN), a biometric reading of a thumb print, and a facial picture of a parcel delivery person.

When the parcel delivery person arrives to deliver the parcel, the obtain module (319-2), receives, from an access input code device, an input access code. The access input code device includes a 10-key input pad, a finger print reader, and an input observation camera. The parcel delivery person approaches the parcel delivery apparatus (100) and is observed by the input observation camera. The input observation camera takes a input picture of the parcel delivery person. The parcel delivery person places a thumb on a biometric fingerprint reader to create an input thumb print. The parcel delivery person enters an entered PIN on the 10-key input pad. Collectively these readings are referred to as an input access code.

The unlock module (319-3) may unlock a door to allow parcel delivery when the input access code meets the criteria of the access configuration parameters. In this example, an entered PIN is compared to the pin in the access configuration parameters. The input thumb print is compared to the biometric reading of the thumb print in the access configuration parameters. Facial recognition algorithms compares the picture from the input observation camera and the facial picture of the parcel delivery person. The input access code meets the criteria of the access configuration parameters and the door is unlocked.

The monitor module (319-4) monitor that the parcel delivery person remains in the field of vision of the interior camera. The monitor module (319-4) monitors that the parcel delivery person stays within a portion of the field of vision of the interior camera. Here, the parcel delivery person does stay in an allowed portion of the field of vision of the interior camera until the parcel delivery person leaves.

The alarm module (319-5) does not act in this example, as the parcel delivery person remains in the allowed portion of the field of vision of the interior camera.

The lock module (319-6) locks the door after the parcel is delivered and the parcel delivery person leaves.

A second overall example using FIG. 3 will now be given. In this example, the access configuration parameters are received as described in the first overall example. The receive module (319-1) receives, over the network interface connection (212), a number of access configuration parameters. When the parcel delivery person arrives to deliver the parcel, the obtain module (319-2), receives, from an access input code device, an input access code. The unlock module (319-3) may unlock a door to allow parcel delivery when the input access code meets the criteria of the access configuration parameters.

The monitor module (319-4) monitor that the parcel delivery person remains in the field of vision of the interior camera. In this example, the parcel delivery person deviates from the allowed portion of the field of vision of the interior camera. The monitor module (319-4) invokes the alarm module (319-5).

The alarm module (319-5) issues an alarm using the network interface connection. The alarm invokes a security systems summoning security personnel. A notice is sent to the resident of the house (FIG. 1, 130). The information in the input access code is recorded to potentially identify the wayward parcel delivery person.

The lock module (319-6) is invoked when the door is closed, even though the alarm module (319-5) has been invoked.

Figure 4:
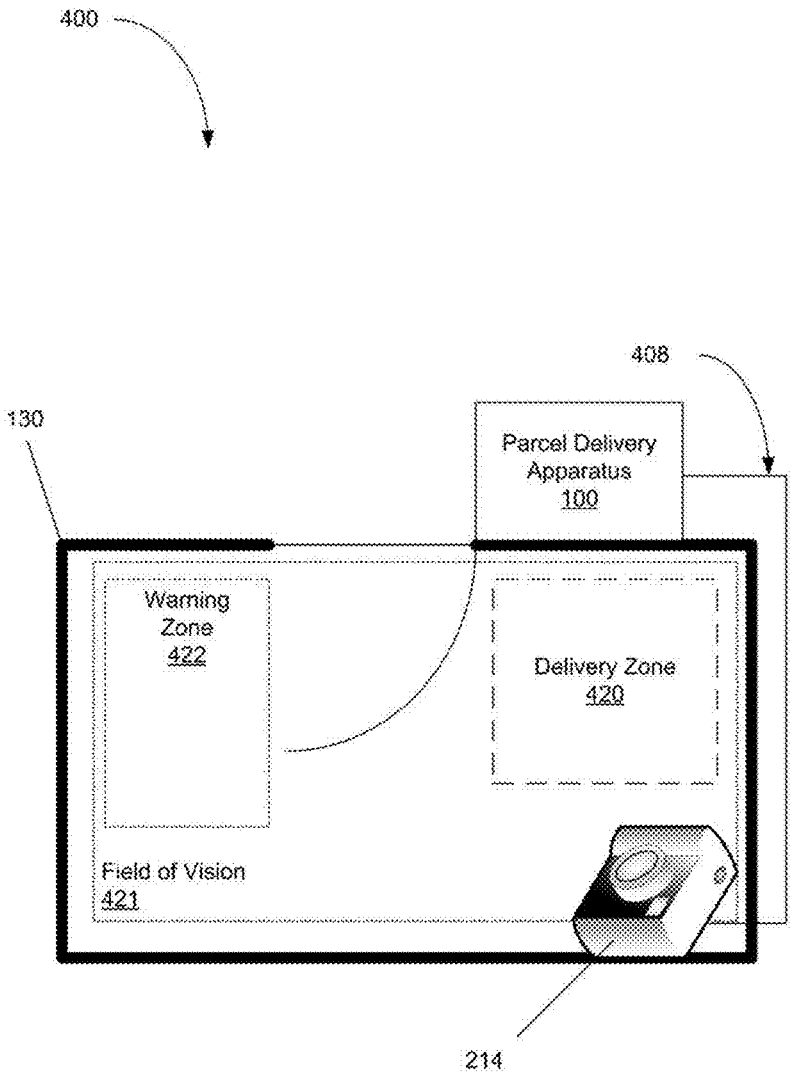
FIG. 4 illustrates a use of a system for receiving packages using a parcel delivery apparatus.

FIG. 4 illustrates a system (400) to receive a parcel. The system includes a house (130) and a parcel delivery apparatus (100). The interior camera (214) is illustrated as a part of the parcel delivery apparatus (100), though it is placed where the interior camera (214) has a better view of door. There is a communicative connection (408) to include the interior camera (214) to the processor in the parcel delivery apparatus (100).

The interior camera (214) has a field of vision (421). The field of vision is the area of the house (130). The field of vision (421) includes a delivery zone (420) and a warning zone (422). The delivery zone (420) is an area of the field of vision (421) of the interior camera (214) where a parcel is to be placed when it is delivered. The field of vision (421) includes a warning zone (422). The warning zone (422) is an area of the field of vision where a parcel delivery person is not allowed. The when a parcel delivery person enters the warning zone (422) the alarm module (FIG. 3, 319-5) issues an alarm.

Figure 5:
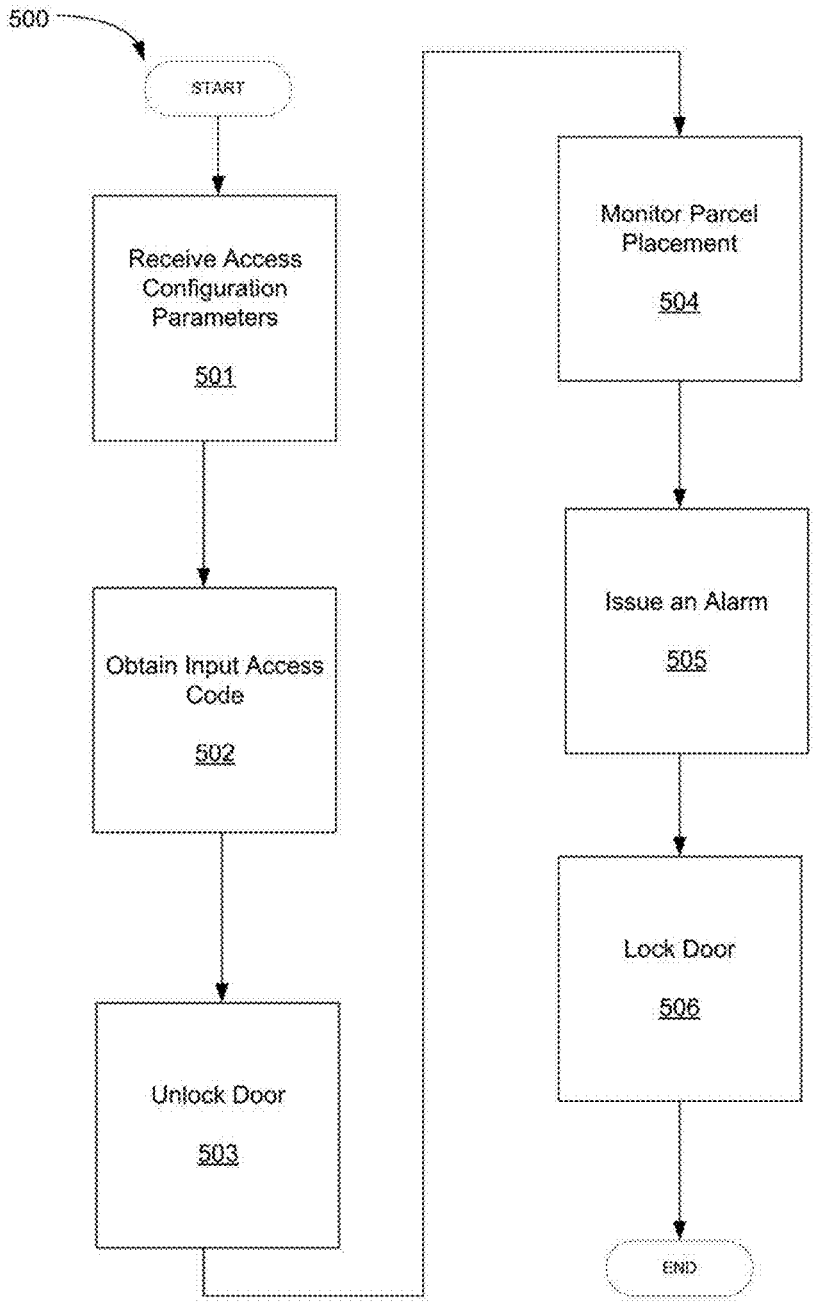
FIG. 5 illustrates a method for receiving a parcel using a parcel delivery apparatus.

FIG. 5 illustrates a method (500) for receiving a parcel using a parcel delivery apparatus (FIG. 1, 100). The method (500) includes receiving (501) a number of access configuration parameters, obtaining (502) an input access code, unlocking (503) a door to allow parcel delivery, monitoring (504) parcel placement within a expected field of vision of the interior camera, issuing (505) an alarm when the parcel delivery person leaves the expected field of vision of the interior camera, and locking (506) the door after the parcel is delivered.

The method (500) includes receiving (501), a number of access configuration parameters may use the network communication interface (FIG. 2, 212). The number of access configuration parameters may include any combination information about an allowed access, such as an access code, an access time, a biometric identifier, or information related to facial recognition.

The method (500) includes obtaining (502) an input access code. The input access code may be obtained (502) from an access code input device. The input access code indicates that a user has requested limited access to an area for parcel delivery according to the access configuration parameters. The input access code may use data input from a number of data input devices. The input access code may be recorded to track both authorized and unauthorized entries or attempted entries into the parcel delivery area.

The method (500) includes unlocking (503) a door to allow parcel delivery. The unlocking may include unlocking a number of locks associated with the door. The unlocked door may be opened by a parcel delivery person.

The method (500) includes monitoring (504) parcel placement within an expected field of vision of the interior camera. The monitoring (504) monitors a parcel delivery person that to observe when the parcel delivery person leaves a parcel delivery zone. The monitoring (504) may allow the parcel delivery person to leave through a known portion of the delivery zone to exit the parcel delivery area.

The method (500) includes issuing (505) an alarm when the parcel delivery person leaves the expected field of vision of the interior camera. The alarm may alert a resident of a violation of the parcel delivery zone.

The method (500) includes locking (506) the door after the parcel is delivered. The locked door protects the parcel from being absconded.

Figure 6:
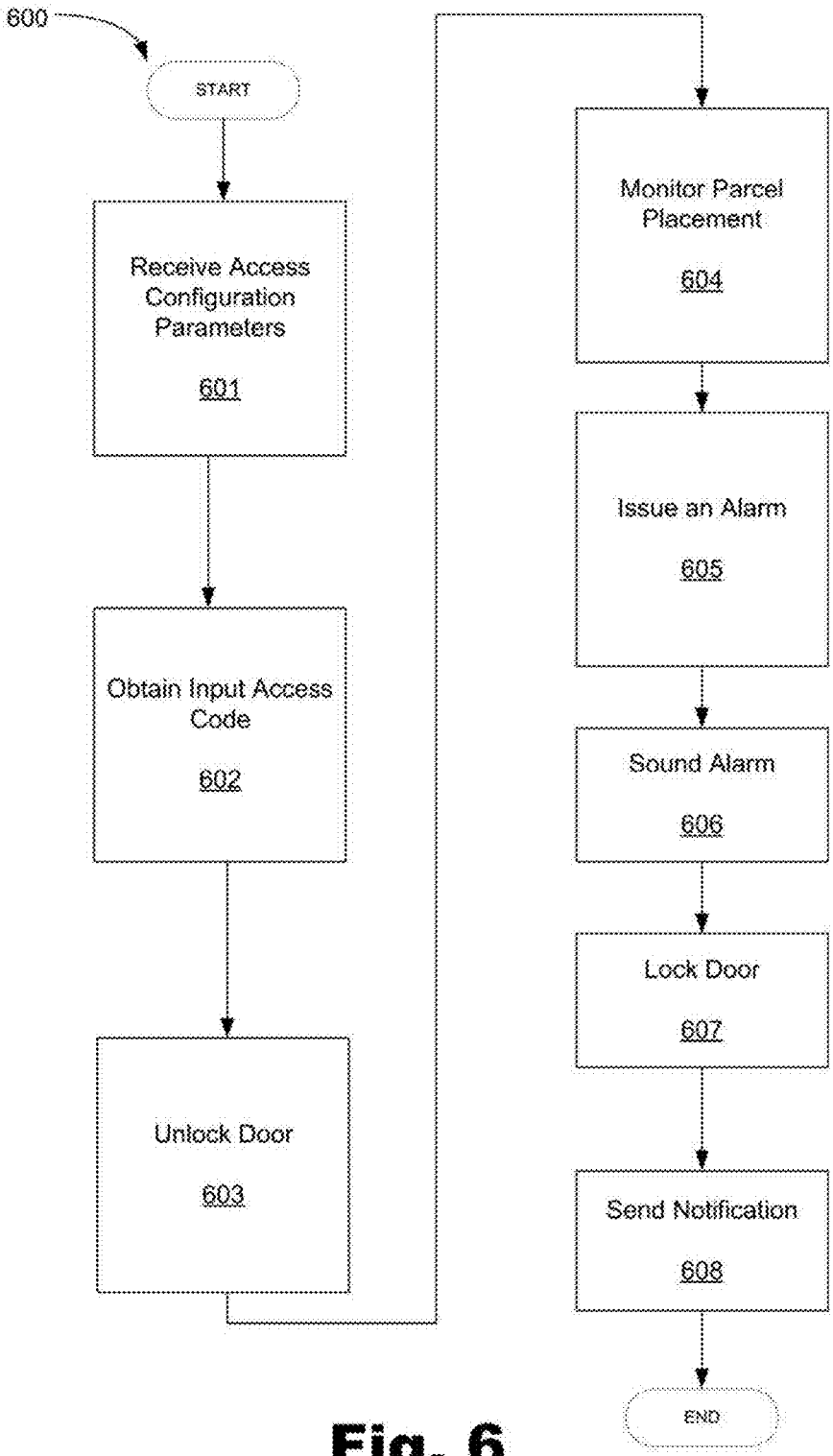
FIG. 6 illustrates a method for receiving a parcel using a parcel delivery apparatus.

FIG. 6 illustrates a method (600) for receiving a parcel using a parcel delivery apparatus (FIG. 1, 100). The method (600) includes receiving (601) a number of access configuration parameters, obtaining (602) an input access code, unlocking (603) a door to allow parcel delivery, monitoring (604) parcel placement within a expected field of vision of the interior camera, issuing (605) an alarm when the parcel delivery person leaves the expected field of vision of the interior camera, sounding (606) an alarm, locking (607) the door after the parcel is delivered and sending a notification and sending (608) a notification.

As described above, the method (600) includes receiving (601), a number of access configuration parameters. As described above, the method (600) includes obtaining (602) an input access code. As described above, the method (600) includes unlocking (603) a door to allow parcel delivery. As described above, the method (600) includes monitoring (604) parcel placement within an expected field of vision of the interior camera. As described above, the issuing (605) an alarm when the parcel delivery person leaves the expected field of vision of the interior camera.

The method (600) includes sounding (606) a local alarm. Sounding a local alarm may scare or interfere with potential criminal activity, causing a party who has exceeded the scope of delivery to be startle the individual and cause said individual to leave the area. The local alarm may emit localized attention signals, such as sound or light.

As described above, the method (600) includes locking (607) the door.

The method (600) includes sending a notification (608) a parcel has been delivered. The notification may be sent using the network interface connection. The notification may be, for example, a text message, an email, a voice message, an email message, or a notice to an application on a device, such as a smart phone, tablet, or a computing device.

The foregoing descriptions of embodiments have been presented only for purposes of illustration and description. They are not intended to be exhaustive or to limit the embodiments to the forms disclosed. Accordingly, many modifications and variations will be apparent to practitioners skilled in the art. Additionally, the above disclosure is not intended to limit the embodiments. The scope of the embodiments is defined by the appended claims.

The invention claimed is:

1. An apparatus is affixed to a house or a building for receiving a parcel through a door of the house or the building, the apparatus comprising:

a processor;

a network interface connection, communicatively connected to the processor;

a passcode entry station, communicatively connected to the processor;

an interior camera, communicatively connected to the processor; and a non-transitory storage medium connected to the processor, the non-transitory storage medium comprising:

a receive module to receive, over the network interface connection, a number of access configuration parameters, the number of access configuration parameters comprising an access code and an access time;

an obtain module, from an access code input device, an input access code, the input access code indicating that a user has requested limited access to an area for parcel delivery according to the access configuration parameters;

an unlock module to unlock the door of the house or the building to allow parcel delivery;

a monitor module, to monitor that the parcel delivery person remains in a field of vision of the interior camera; an alarm module, to issue, using the network interface connection, an alarm when the parcel delivery person leaves the field of vision of the interior camera; and a lock module, to lock the door of the house or the building after the parcel is delivered.

2. The apparatus of claim 1, wherein the passcode entry station comprises a number of entry keys for numeric values.

3. The apparatus of claim 1, wherein the passcode entry station comprises five entry keys to enter the passcode.

4. The apparatus of claim 1, wherein the passcode entry station further comprises an input observation camera, the input observation camera focused on an individual entering a passcode.

5. The apparatus of claim 4, wherein the input observation camera performs facial recognition.

6. The apparatus of claim 1, wherein the passcode entry station comprises a isometric input sensor.

7. The apparatus of claim 1, further comprising a delivery zone indicator, the delivery zone indicator indicating an acceptable area for a delivery to occur.

8. The apparatus of claim 7, wherein the delivery zone indicator is a illumination light, the illumination light indicating where the delivery zone is.

9. The apparatus of claim 7, wherein the delivery zone indicator is a number of lasers, the number of lasers indicating where the delivery zone is.

10. The apparatus of claim 7, further comprising a siren, communicatively connected to the processor, the siren being activated by the alarm module.

11. A method for receiving a parcel through a doorway using a parcel delivery apparatus affixed to a house or a building, the method comprising:

receiving, over a network interface connection, a number of access configuration parameters, the number of access configuration parameters comprising an access code and an access time;

obtaining, from an access code input device, an input access code, the input access code indicating that a user has requested limited access to an area for parcel delivery according to the access configuration parameters;

unlocking a door of the house or the building by a person to allow parcel delivery;

monitoring parcel placement within a expected field of vision of the interior camera;

issuing, using the network interface connection, an alarm when the parcel delivery person leaves the expected field of vision of the interior camera; and locking the door of the house or the building after the parcel is delivered.

12. The method of claim 11, wherein the access code is a biometric reading of an intended parcel delivery person.

13. The method of claim 11, wherein obtaining, from an access input device, an input access code comprises reading a number of biometric sensors.

14. The method of claim 11, wherein obtaining, from an access input device, an input access code further comprises recording the input access code.

15. The method of claim 14, wherein issuing an alarm when the parcel delivery person leaves the expected field of vision of the interior camera includes sending the input access code.

16. The method of claim 11, further comprising sounding an alarm, the alarm emitting localized attention signals.

17. The method of claim 11, further comprising sending, via the network interface connection, a notification, the notification indicating that the parcel has been delivered.

18. The method of claim 11, further comprising sounding an alarm, the alarm emitting localized attention signals, and simultaneously sending, via the network interface connection, a notification, the notification indicating that the parcel has been delivered.

19. The method of claim 14, wherein issuing an alarm when the parcel delivery person leaves the expected field of vision of the interior camera includes sending the input access code to a third party authorized to enter the doorway and investigate the alarm.

20. The method of claim 13 wherein the number of biometric sensors includes a facial recognition sensor and a body odor sensor comprising a conduit configured to receive body odorants and an odorant analyzer configured to receive a body odor profile of a person that enters a doorway after entering an access code.

* * * * *